US011469488B2

(12) United States Patent
Castronova et al.

(10) Patent No.: US 11,469,488 B2
(45) Date of Patent: Oct. 11, 2022

(54) THERMAL MANAGEMENT SYSTEM FOR MODULAR ANTENNA HOUSING

(71) Applicant: Comptek Technologies, LLC, Boulder, CO (US)

(72) Inventors: Dana Anthony Castronova, Westminster, CO (US); Kenneth Michael Hoganson, Aurora, CO (US)

( * ) Notice: Subject to any disclaimer, the term of this patent is extended or adjusted under 35 U.S.C. 154(b) by 56 days.

(21) Appl. No.: 17/156,779

(22) Filed: Jan. 25, 2021

(65) Prior Publication Data

US 2021/0313666 A1 Oct. 7, 2021

Related U.S. Application Data

(63) Continuation-in-part of application No. 16/837,234, filed on Apr. 1, 2020, now Pat. No. 11,201,382.

(51) Int. Cl.

| | |
|---|---|
| ***H01Q 1/24*** | (2006.01) |
| ***H01Q 1/02*** | (2006.01) |
| ***H01Q 1/12*** | (2006.01) |

(52) U.S. Cl.
CPC ..... *H01Q 1/02* (2013.01); *H01Q 1/1242* (2013.01); *H01Q 1/246* (2013.01)

(58) Field of Classification Search
CPC ..... H01Q 1/02; H01Q 1/1242; H01Q 1/246; H01Q 1/2291; H01Q 1/1228
See application file for complete search history.

(56) References Cited

U.S. PATENT DOCUMENTS

| | | | | |
|---|---|---|---|---|
| 4,224,082 | A | 9/1980 | Jacobson | |
| 6,167,673 | B1 | 1/2001 | Fournier | |
| 9,698,477 | B1 | 7/2017 | Jabara et al. | |
| 10,505,271 | B2 | 12/2019 | Constance et al. | |
| 10,763,575 | B2 | 9/2020 | Constance et al. | |
| 10,947,751 | B2 * | 3/2021 | Lockwood | E04H 12/02 |
| 2003/0233806 | A1 | 12/2003 | Ulrich | |
| 2004/0070985 | A1 | 4/2004 | Haddad | |
| 2009/0040750 | A1 * | 2/2009 | Myer | F21S 9/037 136/246 |
| 2010/0023146 | A1 | 1/2010 | Hatano et al. | |
| 2010/0026604 | A1 | 2/2010 | Caldwell | |
| 2010/0231469 | A1 * | 9/2010 | Kim | H01Q 1/246 343/890 |
| 2015/0068711 | A1 * | 3/2015 | Kashihara | F24F 1/0059 165/121 |
| 2015/0349399 | A1 * | 12/2015 | Lasier | H01Q 1/1242 248/542 |
| 2016/0146438 | A1 | 5/2016 | LaFemina | |
| 2017/0030571 | A1 | 2/2017 | Kawahara | |
| 2017/0122546 | A1 | 5/2017 | Abbott et al. | |
| 2017/0279187 | A1 * | 9/2017 | Lockwood | H01Q 1/42 |

(Continued)

*Primary Examiner* — Awat M Salih
(74) *Attorney, Agent, or Firm* — Russell Manning; FisherBroyles, LLP

(57) ABSTRACT

An antenna housing configured to house a wireless antenna unit. The antenna housing defines an interior space sized to receive the antenna unit. Inlet and outlet ducting extend through a sidewall of the housing to connect to an internal cooling duct of the antenna unit allowing air to be drawn from outside the housing, through the antenna unit and expelled out of the hosing without intermingling with air in the interior of the housing. Additional airflow paths extend around side and/or rear surfaces antenna unit to provide additional cooling.

14 Claims, 8 Drawing Sheets

(56) References Cited

U.S. PATENT DOCUMENTS

| | | | | |
|---|---|---|---|---|
| 2018/0077324 | A1 | 3/2018 | Adrain | |
| 2018/0172229 | A1* | 6/2018 | Lockwood | F21S 9/037 |
| 2018/0219278 | A1 | 8/2018 | Wigdahl et al. | |
| 2018/0351245 | A1* | 12/2018 | Constance | H01Q 1/245 |
| 2019/0137084 | A1 | 5/2019 | Kim et al. | |
| 2020/0082953 | A1* | 3/2020 | Singh | G21F 5/12 |
| 2020/0118054 | A1 | 4/2020 | Bayges | |
| 2020/0136236 | A1* | 4/2020 | Colapietro | H01Q 21/0025 |
| 2020/0190842 | A1 | 6/2020 | Ducros et al. | |

* cited by examiner

THERMAL MANAGEMENT SYSTEM FOR MODULAR ANTENNA HOUSING

CROSS REFERENCE

The present application is a continuation-in-part of U.S. patent application Ser. No. 16/837,234 having a filing date of Apr. 1, 2020, the entire contents of which are incorporated herein by reference.

FIELD

The present disclosure is broadly directed to antenna housings utilized with wireless access points that provide coverage for local service areas. More specifically, the present disclosure is directed to antenna housings having multiple individual cooling paths.

BACKGROUND

In wireless communication networks, high-powered base stations (e.g., towers supporting antennas) commonly provide service over large geographic areas. Each base station is capable of serving wireless user devices in a coverage area that is primarily determined by the power of the signals that supported antennas can transmit. Frequently, high-powered base stations (e.g., macro stations) are located in a grid pattern with each base station mounting various antennas elevated on a tower. While such towers have previously provided adequate coverage for many wireless applications, such high-powered base stations tend to be too widely spaced for newer high-bandwidth wireless applications.

To improve wireless access, providers are moving toward smaller stations that provide enhanced coverage for more limited geographic areas. That is, to augment the coverage of the wireless network, wireless transceiver devices/antennas (e.g., access points) with relatively small coverage areas (and serving capacities) are deployed. Depending on their coverage area and serving capacities, these wireless transceiver devices are referred to as "femto" cells or "pico" cells. For simplicity and generality, the term "small cell pole" is used herein to refer to a wireless transceiver access point that is configured to serve wireless user devices over relatively small coverage areas as compared to a high-powered base station that is configured to serve a relatively large coverage area ("macro cell").

The increasing use of RF bandwidth or 'mobile data' has required a corresponding increase in the number of access points to handle the increased data. By way of example, 5G wireless networks providing improved network speeds are currently being planned and implemented. Such networks typically require shorter RF transmission distances compared to existing networks and thereby require more dense networks of access points. Along these lines, access points are, in some instances, being installed in urban areas to serve several city blocks or even to serve a single city block. Such installations are often below roof-top level of surrounding buildings. That is, access points are being installed at 'steel-level' sites typically on small dedicated small cell poles as well as on existing utility poles (e.g., streetlights, stoplights, etc.). The increasing number of access points is sometimes referred to as densification of wireless infrastructure. Residents often object to such densification in their neighborhoods due to the aesthetic concerns of wireless antennas supported by various dedicated and/or existing utility poles. To help alleviate aesthetic concerns, wireless provider commonly conceal antennas supported by such poles within a shrouding or antenna housing. Antenna housings having a minimal form factor necessary to house an antenna are typically preferred to minimize to overall obtrusiveness of a set of antennas supported by a pole.

SUMMARY

The present disclosure is directed to antenna housings utilized to house individual antennas. Such an individual antenna and individual housing may be considered a modular antenna unit. When modular antenna units are utilized, an access point will typically have three units disposed about a support pole to provide coverage for three 120 degree sectors. Variation is possible. Aspects of the present disclosure are based on the realization that the ever increasing antenna power to enhance coverage and/or data transfer in conjunction with efforts to minimize the size (e.g., small form factor) of antenna housings to address aesthetic concerns can result in thermal management concerns for modular antenna units. That is, the small form factor housing may not provide adequate ventilation to allow effectively cooling an antenna disposed within the housing. In this regard, heat generated by operation of the antenna is at least partially contained within the housing, which can result in the antenna operating in a thermal environment above recommended operation temperatures. Accordingly, the present disclosure is directed to a modular antenna housing that provides multiple ducting paths through the housing to provide better cooling and thereby reduce temperatures within an interior of the antenna housing.

In one implementation, an antenna housing is provided. The antenna housing is primarily configured to be mounted to a pole. The antenna housing may be a modular housing configured to hold a single antenna. Typically, such an antenna(s) is at least partially disposed within the interior of the antenna housing such that it is partially concealed. That is, the antenna(s) is at least partially enclosed within a sidewall and/or shrouding of the housing. When housing an antenna, an active or emitting surface of the antenna is typically directed outward from the interior of the housing. In some arrangements, an emitting surface may be exposed through an aperture in the sidewall and/or shrouding.

In order to provide cooling to an internal cooling duct of an antenna is disposed within the housing, the housing may further include an inlet duct and an outlet duct. These ducts extend through a sidewall of the housing. These ducts allow air to be drawn into the housing, pass through the internal cooling duct of the antenna unit and be exhausted from the housing. The inlet, cooling and outlet duct provide a closed (e.g., substantially sealed) airflow path into and out of the housing. Additionally, spaces between outside surfaces or the antenna unit and inside surfaces of the housing provide additional air flow paths (e.g., between various vents in the housing) around the antenna unit. These additional flow paths may be at least partially isolated from one another and provide. Further, the additional flow paths may provide an effective means for removing heat caused by solar irradiation from the housing.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

The present disclosure is broadly directed to wireless antenna housings that are primarily intended to house individual wireless antennas. Such a combined housing and antenna may be referred to as a modular antenna unit. In various embodiments, the antenna housings are configured to at least partially conceal a wireless antenna within an enclosed interior of the housing to minimize the aesthetic obtrusiveness of the modular antenna unit. Various embodiments of the present disclosure are related to the recognition by the inventors that the use of increasingly more powerful wireless antennas in modular antenna units can result in thermal concerns. That is, when an antenna is at least partially concealed within an enclosed interior of an antenna housing, heat generated during operation of the antenna tends to build up within the housing. Additionally, it has been recognized that in many geographical locations, heating from exposure to the sun can significantly increase the overall heat load within the housing. This may be exacerbated when the antenna units are elevated, which commonly results in the antenna units being fully exposed to the sun. The combination of heat generated by the antenna and solar loading can result in the enclosed antenna operating in a thermal environment above recommended operation temperatures. Accordingly, the present disclosure is directed to an antenna housing that provides multiple cooling paths through the housing to regulate temperatures within the housing.

Figure 1:
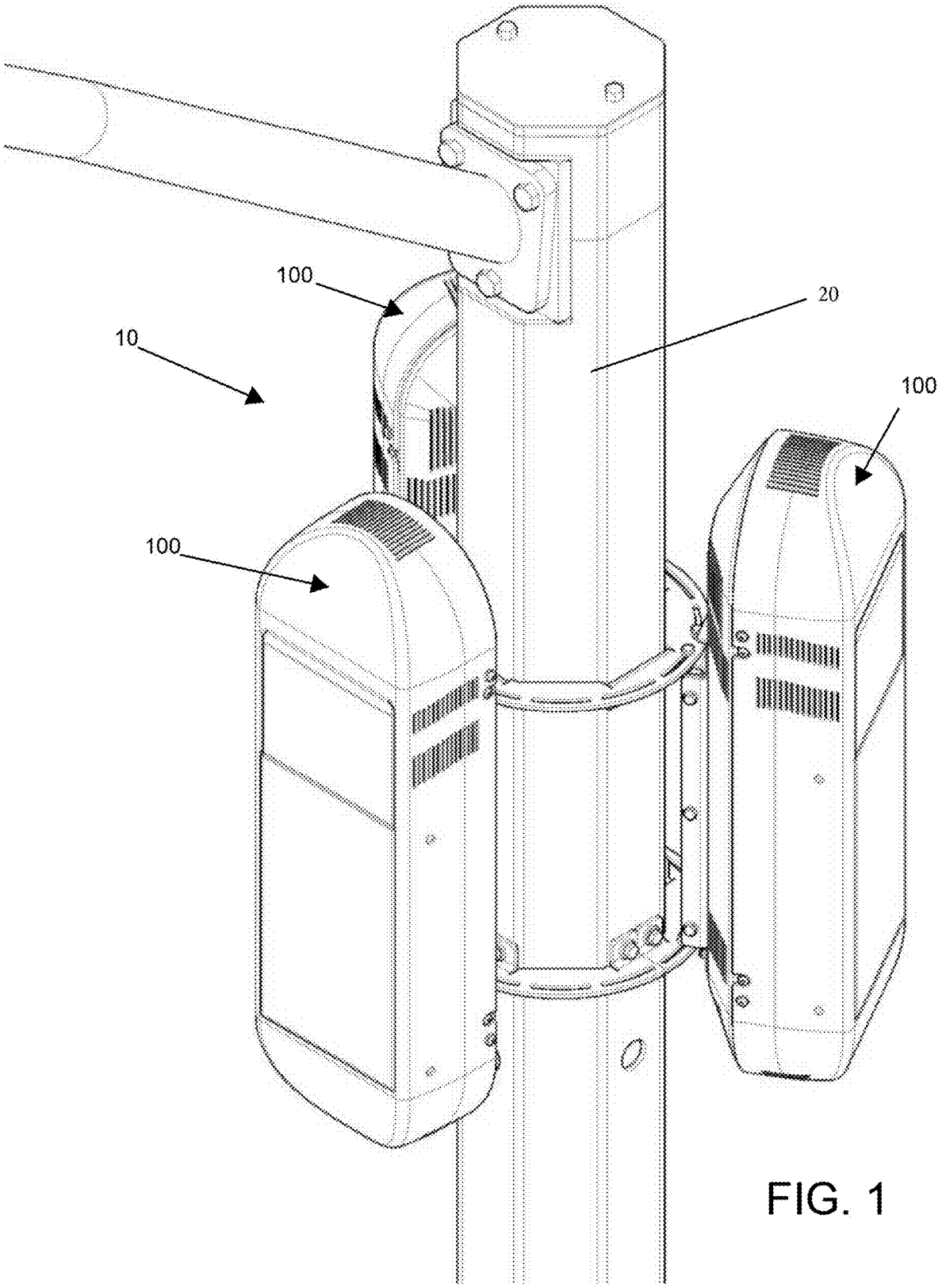
FIG. 1 illustrates one embodiment of a wireless access point.

FIG. 1 illustrates one embodiment of a wireless access point 10. As shown, the wireless access point 10 includes three modular antenna units 100 attached to a support pole 12. The support pole may be a dedicated cell pole or an existing utility pole (e.g., streetlight), which may be located within a public right-of way (e.g., on a sidewalk). In the illustrated embodiment, the three antenna units 100 provide coverage for three 120 degree sectors. Variation is possible. That is, some access points may utilize fewer or more modular antennas.

As previously noted, wireless providers continue to increase the power of the antennas utilized for local coverage. By way of example, previous generations of antennas (e.g., 4G antennas) often had operational powers of around 150 watts. A thermal load of an antenna enclosed within a housing could be managed by providing vents at or near the bottom of the housing and vents at or near the top of the housing. Such vents permitted removal of heat from the housing via natural or forced convention. However, newer antennas (e.g., 5G antennas) having higher operational power (e.g., 400-500 watts) may produce more heat than can be removed utilizing such simplified venting. When such an antenna is enclosed within a housing, heat generated during operation tends to build up. This is further complicated in applications where antenna housings are subject to direct sunlight. Specifically, heat from sunlight incident on front, sides and/or rear surfaces of the housing move tend to move upward into an upper portion of housing, further increasing the temperature within the upper housing. The combined heat within the housing may exceed the ability of vents in the upper surface of the housing to effectively cool the antenna. Accordingly, it is desirable to more effectively vent heat from within an antenna housing.

Figure 2A:
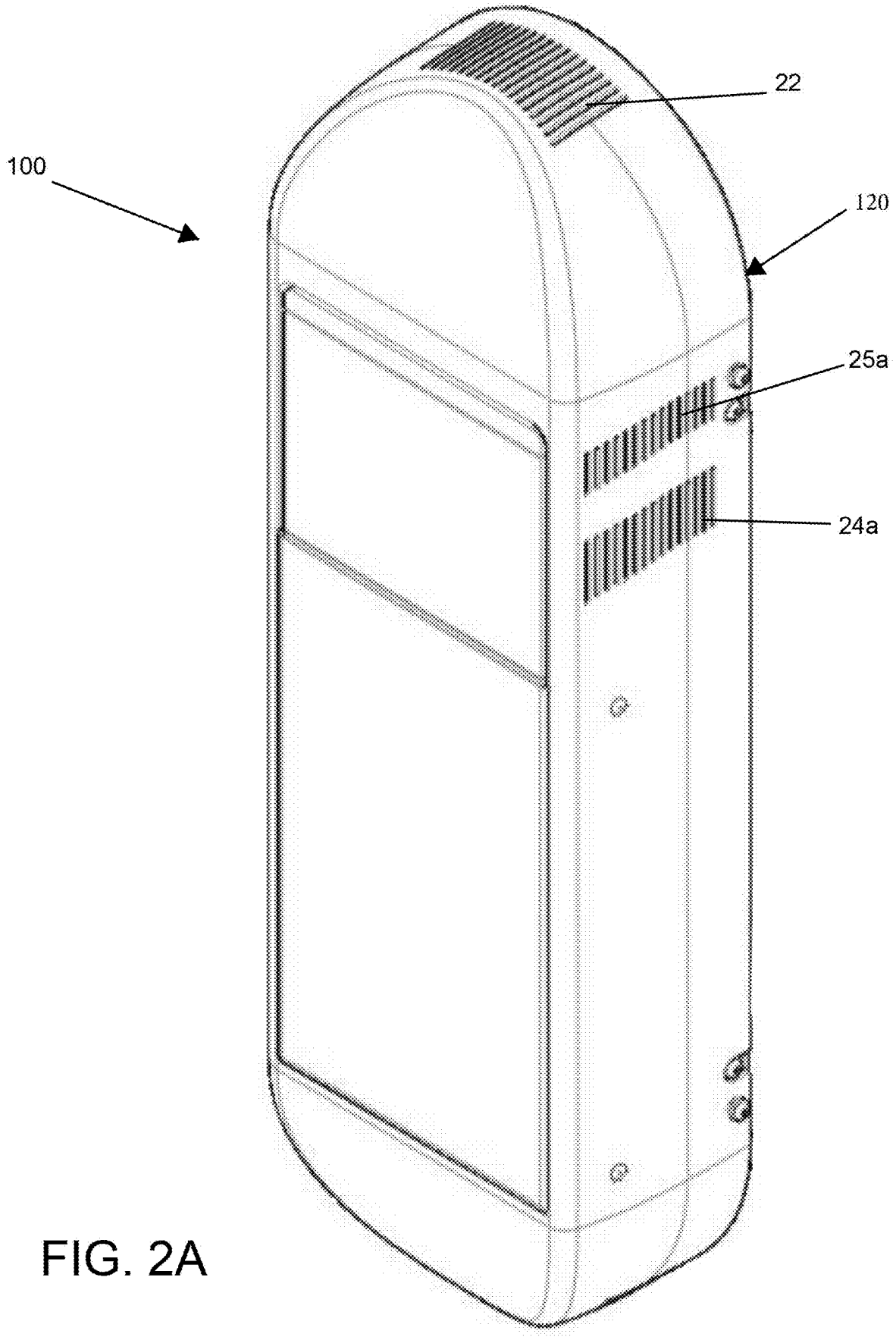
FIG. 2A illustrate one embodiment of a modular antenna assembly.
Figure 2B:
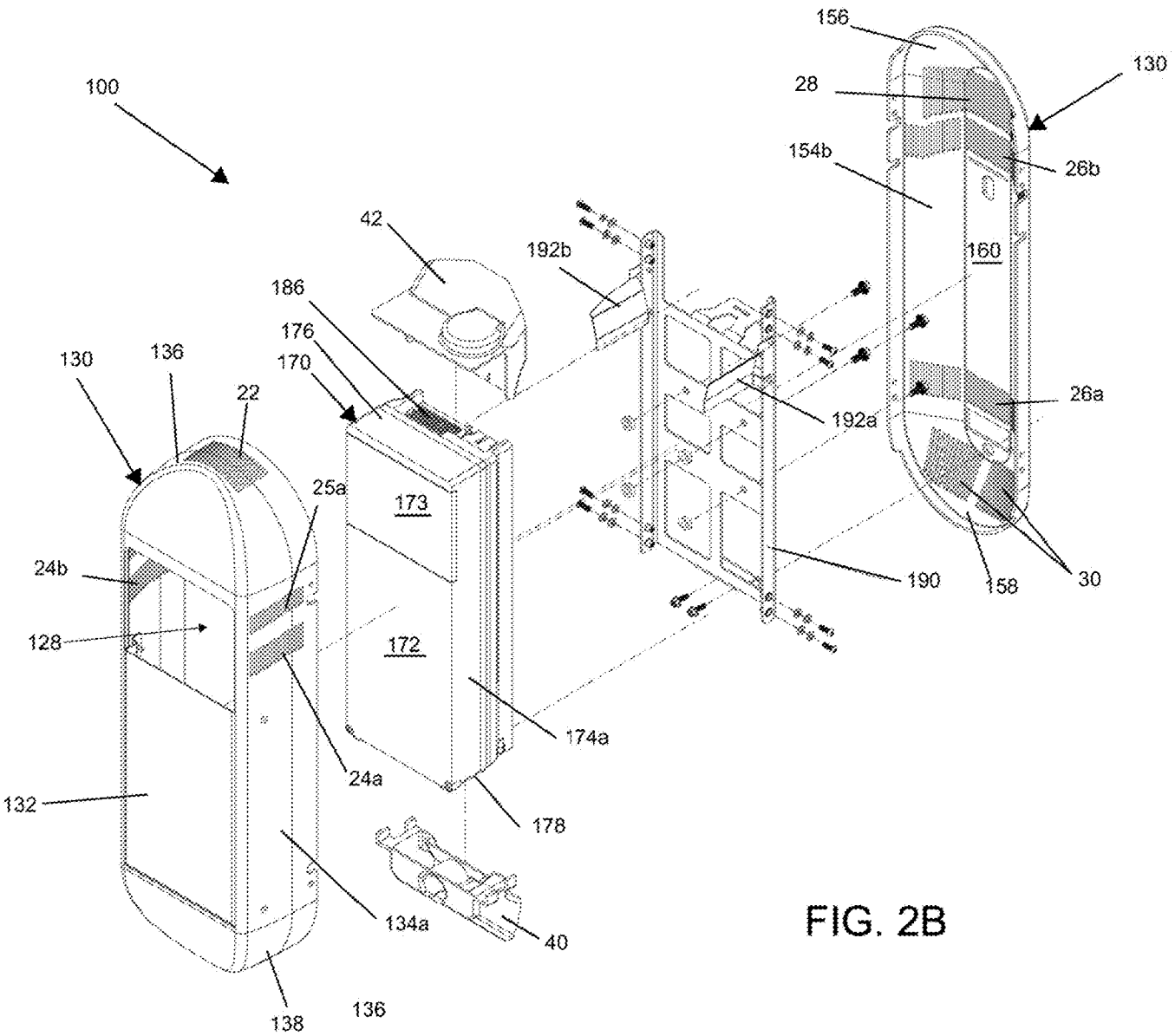
FIGS. 2B and 2C show perspective front and perspective rear exploded views of the modular antenna assembly.
Figure 2C:
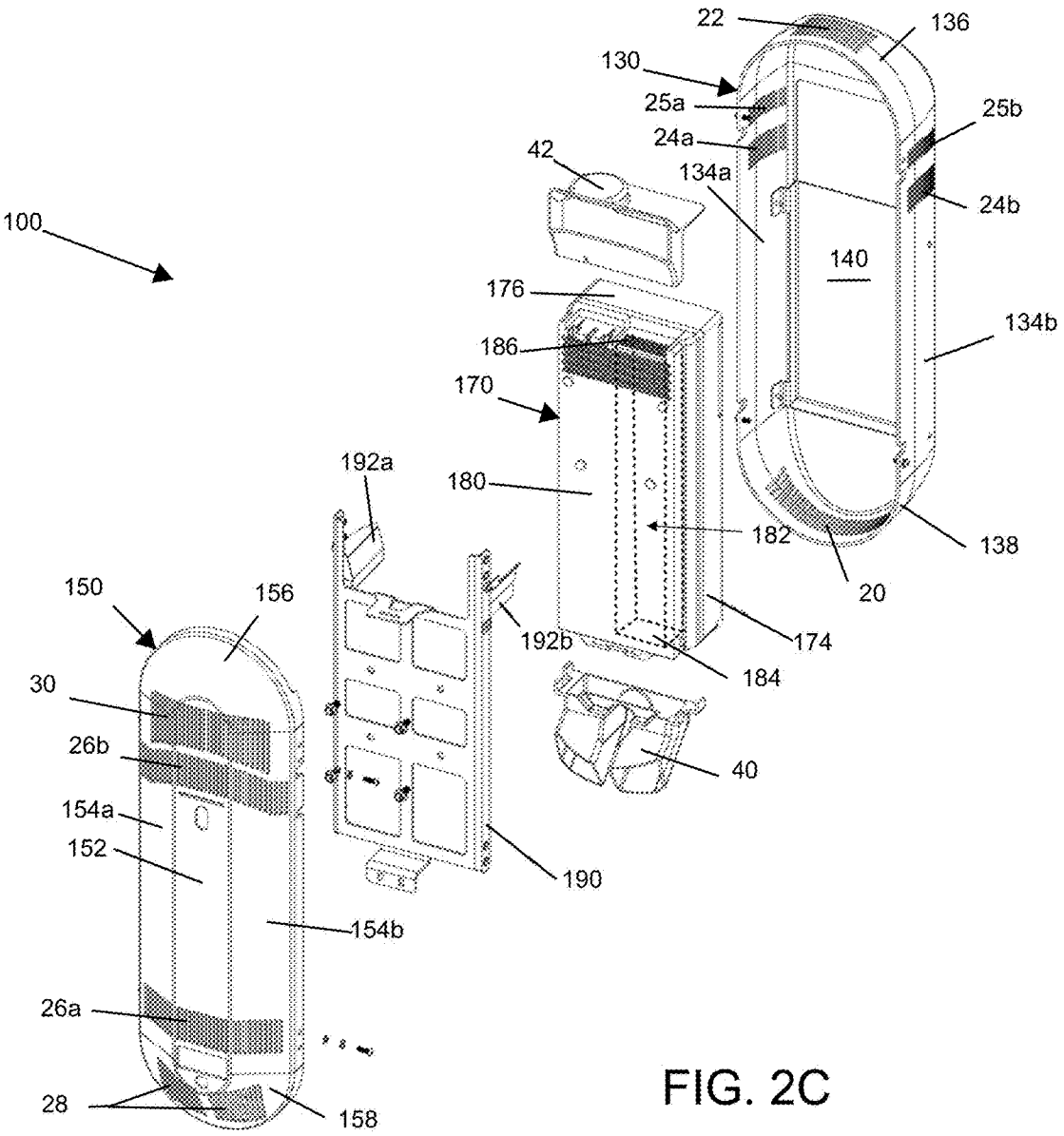

FIGS. 2A, 2B and 2C illustrate front perspective assembled, front perspective exploded, and rear perspective exploded views, respectively, of one embodiment of a modular antenna assembly 100. As shown, the modular antenna assembly 100 includes an elongated housing 120 having a front shroud 130 and a rear shroud 150 that, when assembled, form a generally hollow interior sized to house an antenna unit 170. The front shroud 130 includes a front sidewall or surface 132, two elongated sidewalls 134*a*, 134*b*, an upper end wall 136 and a lower end wall 138. As illustrated the front surface has an opening 128 that is positioned over a radome 173 (e.g., emitting surface) of the antenna unit 170. The sidewalls 134*a*, 134*b* (hereafter 134 unless specifically referenced) and end walls 136, 138 extend from the front surface 132 to define a generally recessed interior of the front shroud 130. That is, a rearward or inside surface 140 of the front shroud is open and recessed to receive an antenna 170. As is more fully discussed herein, the sidewalls 134 are spaced apart to provide a space between adjacent sidewalls of an antenna unit 170, when the antenna 170 is disposed within the hollow interior of the front shroud. The spaces between exterior sidewalls of the antenna and the interior surfaces of the sidewalls 134 define air flow paths or ducts for use in venting the housing.

The rear shroud 150 includes a rear sidewall or surface 152, two elongated sidewalls 154*a*, 154*b*, an upper end wall 156 and a lower end wall 158. The sidewalls 154*a*, 154*b* (hereafter 154 unless specifically referenced) and end walls 156, 158 extend from the rear surface 152 to define a generally recessed interior of the rear shroud 150. That is, a forward or inside surface 160 of the rear shroud 150 is open and recessed. In the illustrated embodiment, the sidewalls and ends walls generally define a frustum. However, this is not a requirement. A backing plate assembly 190 attached to the to the rearward and side surfaces of the antenna unit 170 via various fasteners. Additionally, the backing plate assembly 190 provides connection points for attaching the front and rear shrouds. When assembled, peripheral edges of the end walls and sidewalls of the rear shroud 150 engage with peripheral edges of the end walls and sidewalls of the front shroud 130. The resulting housing 120 has an interior sized to receive the antenna unit 170. Variation of the housing is possible. By way of example, the front shroud may be similar to that described above while the rear shroud may be a substantially flat panel. What is important is that the housing define an interior area sized to house an antenna unit.

In the illustrated embodiment, the antenna unit 170 is a Streetmacro 6701 antenna produced by Ericsson. It will be appreciated that the antenna housing 120 disclosed herein may be utilized with a variety of antennas and that this particular antenna is presented by way of example only. Nonetheless, the Streetmarco antenna unit is representative of a general form of many 5G antenna units currently being installed. As illustrated, the antenna unit 170 includes a generally rectangular prism-shaped housing having a front surface 172 that includes the radome 173, which is a thin walled RF transparent area that protects the forward emitting surface of an RF antenna. The antenna further includes two elongated sidewalls 174*a*, 174*b* (hereafter 174 unless specifically referenced), a top end surface 176 a bottom end surface 178 and a rear surface 180. In addition, the antenna unit 170 includes an internal cooling duct 182 (shown in phantom in FIG. 2C) that passes through the rearward portion of the antenna from an inlet 184 in the bottom end surface to an outlet 186 in the top end surface. The cooling duct 182 typically passes over a heat rejection surface disposed within the interior of the antenna unit 170. The heat rejection surface may be a finned surface (not shown) attached to a rearward surface of the RF antenna. Typically, the antenna unit 170 will include a fan (not shown) to move air through the cooling duct 182 from the inlet 184 to the outlet 186 and over the heat rejection surface cooling the RF antenna. When disposed within the antenna housing 120, the antenna unit 170 is positioned such that a space remains between the sidewalls 174 of the antenna unit and the sidewalls 134 and/or 154 of the housing 120. In addition, the rear surface 180 of the antenna unit is spaced from the interior surface 160 of the rear shroud 150.

To provide cooling for the antenna unit 170 when disposed within the housing 120, the housing includes a number of vents. The illustrated vents are formed as a plurality of elongated apertures extending through various surfaces of the antenna housing. Variation is possible. What is important is that the housing has a number of vent apertures, which in the present disclosure provide substantially sperate air flow paths through the housing 120. As illustrated, the bottom wall 138 of the front shroud 130, which is also the bottom surface of the housing in the illustrated embodiment, includes a vent 20 that allows air to enter into an interior of the lower portion of the housing. The top surface 136 of the front shroud, which is also the top surface of the housing in the illustrated embodiment, also includes a vent 22 that allows heated air to exit from the interior of the housing. Additionally, the side surfaces 134*a*, 134*b* include a first set of sidewall vents 24*a*, 24*b*, extending through the sidewalls. The first set of sidewall vents 24*a*, 24*b* are located toward the upper end of the sidewalls 134*a*, 134*b* (e.g., where the sidewalls 134 meet the upper wall 136). The first set of sidewall vents provide an exhaust exit on the sidewalls for spaces between the side surfaces of the antenna unit and on the sidewalls of the housing. The sidewall may also include an optional second set of sidewall vents 25*a*, 25*b* disposed through the sidewalls 134*a*, 134*b*, respectively, at a location above the first set of sidewall vents 24*a*, 24*b*. These sets of sidewall vents 24*a*, 24*b* and 25*a*, 25*b*, while each opening into an interior of the housing, may open to interior spaces that are at least partially isolated to define separate flow paths for cooling purposes. In the illustrated embodiment, the two sets of vents are separated by deflector plates 192*a*, 192*b*, as further discussed below.

The rear surface of the housing 120 as defined by the rear shroud 150, in the illustrated embodiment, includes two sets of vents. A first set of vents 26*a*, 26*b* extend through the rear surface 152 and/or sidewalls 154 to provide passive cooling (e.g., driven by thermal convection) for a space between the rear surface 180 of the antenna unit 170 and the inside surface 160 of the housing. The second set of vents 28 and 30 may provide venting for the cooling duct 182 of the antenna unit. In this regard, the second set of vents includes a lower air intake vent 28 and an upper air outlet vent 30 that extend through a surface of the shroud 150. In an embodiment, the intake vent 28 connects to the inlet 184 of the antenna unit cooling duct 182 via an intake duct 40 and the outlet vent 30 connects to the outlet 186 of the antenna unit cooling duct 182 via an outlet duct 42. These ducts, 40, 42 allow the antenna unit 170 to draw air from outside of the housing 120 through the cooling duct 182 (i.e., over a heat rejecting surface(s) of the antenna unit) and expel the air out of the housing 120. Such air may pass through the housing 120 without intermingling with air in the interior of the housing. In the absence of the inlet duct 40 and outlet duct 42, heated air from internal cooling duct 182 of the antenna unit 170 would be drawn from the interior of the antenna housing 120 and expelled back into the interior of the antenna housing 120. This would result in inefficient cooling of the antenna and an increased temperatures within the antenna housing.

Figure 3A:
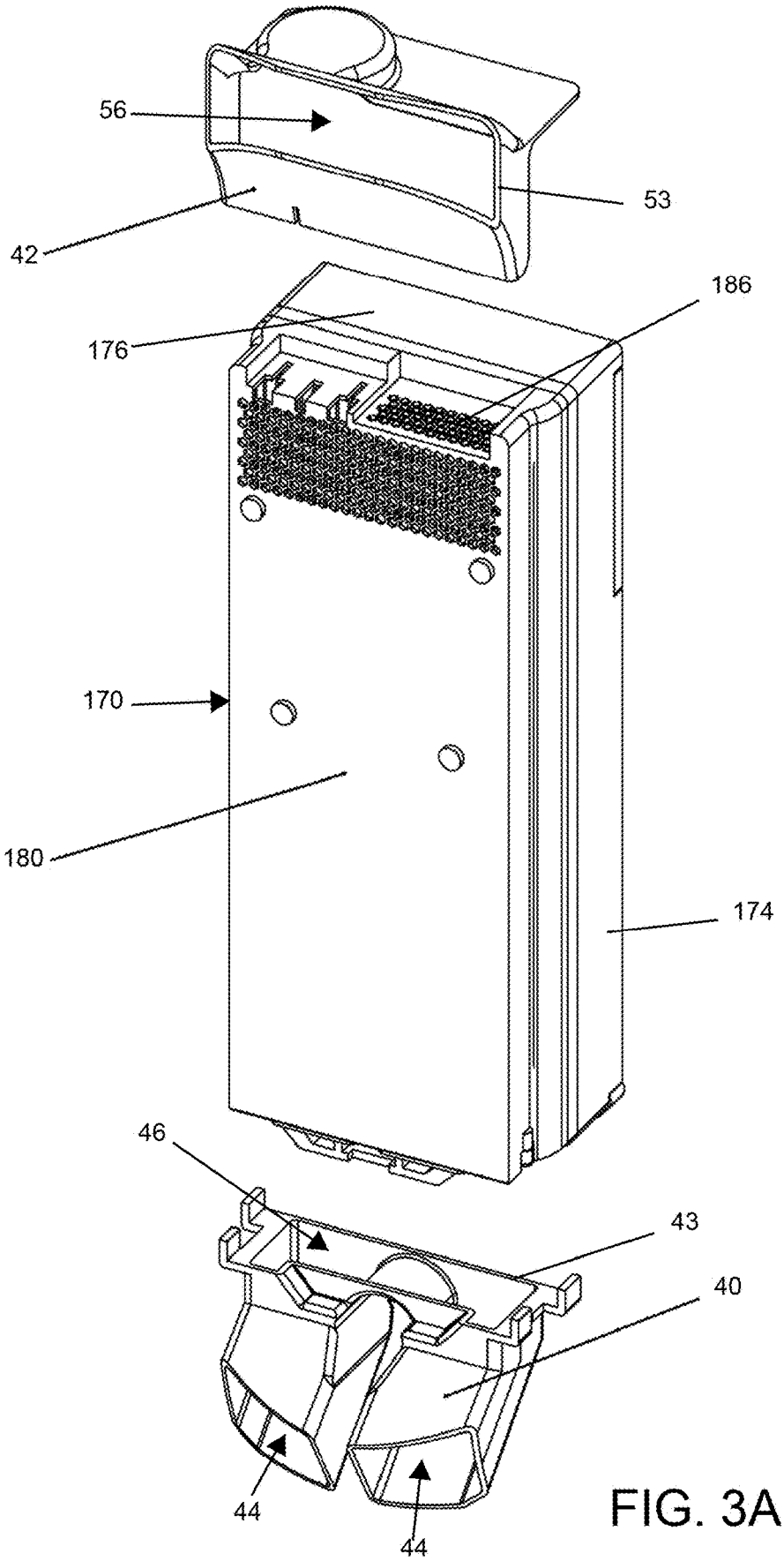
FIG. 3A illustrates one embodiment of a ducts configured for attachment to an antenna unit.
Figure 3B:
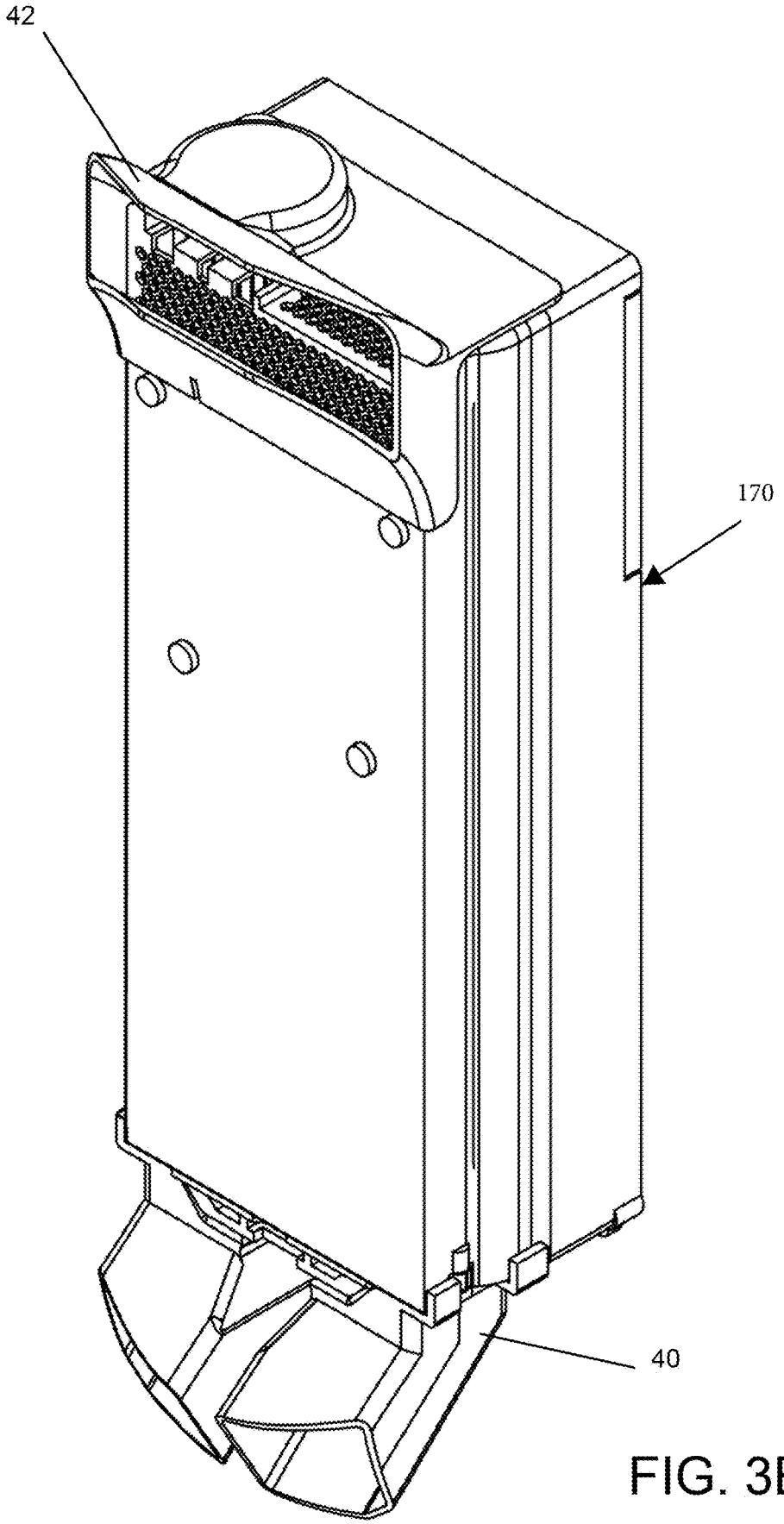
FIG. 3B illustrates the ducts of FIG. 3A attached to the antenna unit.

To allow for drawing ambient air from outside of the antenna housing for cooling the antenna unit, the inlet duct 40 is attached to the bottom surface of the antenna unit 170 such that a hollow interior of the inlet duct 40 is in fluid communication with the inlet of the antenna cooling duct 182. See FIGS. 3A and 3B. Likewise, to allow for exhausting air from the antenna housing, after the air passes over the heat rejection surface of the antenna unit 170, the outlet duct 42 is attached to the top surface 176 of the antenna unit 170 such that a hollow interior of the outlet duct 42 is in fluid communication with the outlet 186 of the antenna cooling duct 182. That is, once connected to the cooling duct 182 of the antenna unit 170, the ducts 40, 42 each vent through a sidewall surface (e.g., shroud) of the antenna housing 20. More specifically, air from outside the housing enters the inlet duct 40, passes through the antenna cooling duct 182, passes through the outlet duct 42 and exhausts outside of the housing 120. The air used to cool the antenna never comingles with air in the interior of the housing. This arrangement significantly reduces the internal temperature of the antenna housing.

As illustrated, the inlet duct 40 is a generally hollow structure having a sidewall 43 that extends from an inlet opening 44 to an outlet opening 46. In the illustrated embodiment, the inlet opening 44 includes two openings disposed side-by-side. However, it will be appreciated that a single opening may be utilized. As shown, front edge surfaces of the two inlet openings 44 are contoured for substantially flush engagement with a rear surface of the housing around the inlet vent 28 formed through the rear shroud 150 of the housing, when the antenna housing is assembled. Further it will be appreciated that a gasket may be disposed around the periphery or peripheries of the inlet(s) 44. Such a gasket may seal an interface between the inlet and the periphery the inlet vent 28 in the shroud, when the antenna housing is assembled. The outlet opening 46 is configured for engagement with the antenna unit 170. In this regard, the outlet may be contoured to engage a specific antenna unit. In an embodiment, a peripheral surfaces around the outlet opening contain an adhesive (e.g., pressure sensitive tape) for attaching the inlet duct 40 to the antenna unit 170. Other connection mechanisms are possible. Likewise, the outlet duct 42 is a generally hollow structure having a sidewall 53 that extends from an inlet opening (not shown) to an outlet opening 56. The inlet opening is configured for engagement with the outlet opening 186 in the top end surface 176 of the antenna unit 170. In this regard, the inlet opening may be contoured to engage a specific antenna unit. As above, the outlet opening may engage with the outlet vent 30.

In the illustrated embodiment, both the inlet duct 40 and outlet duct 42 are generally elbow-shaped. That is, each duct 40,42 has an inlet opening and an outlet opening that are generally disposed in different planes. This shape allows the ducts to extend to or through the sidewall surface (e.g., shroud) of the antenna housing while being able to connect to top and bottom surfaces of the illustrated antenna unit. However, it will be appreciated that the configuration of the ducts may be varied based on a configuration of the antenna housing and/or a configuration of an antenna unit disposed within the housing. What is important is that the ducts are configured to extend from openings or vent in a sidewall or end wall surface of the antenna housing and extend to a duct that is utilized to cool the antenna.

Figure 4:
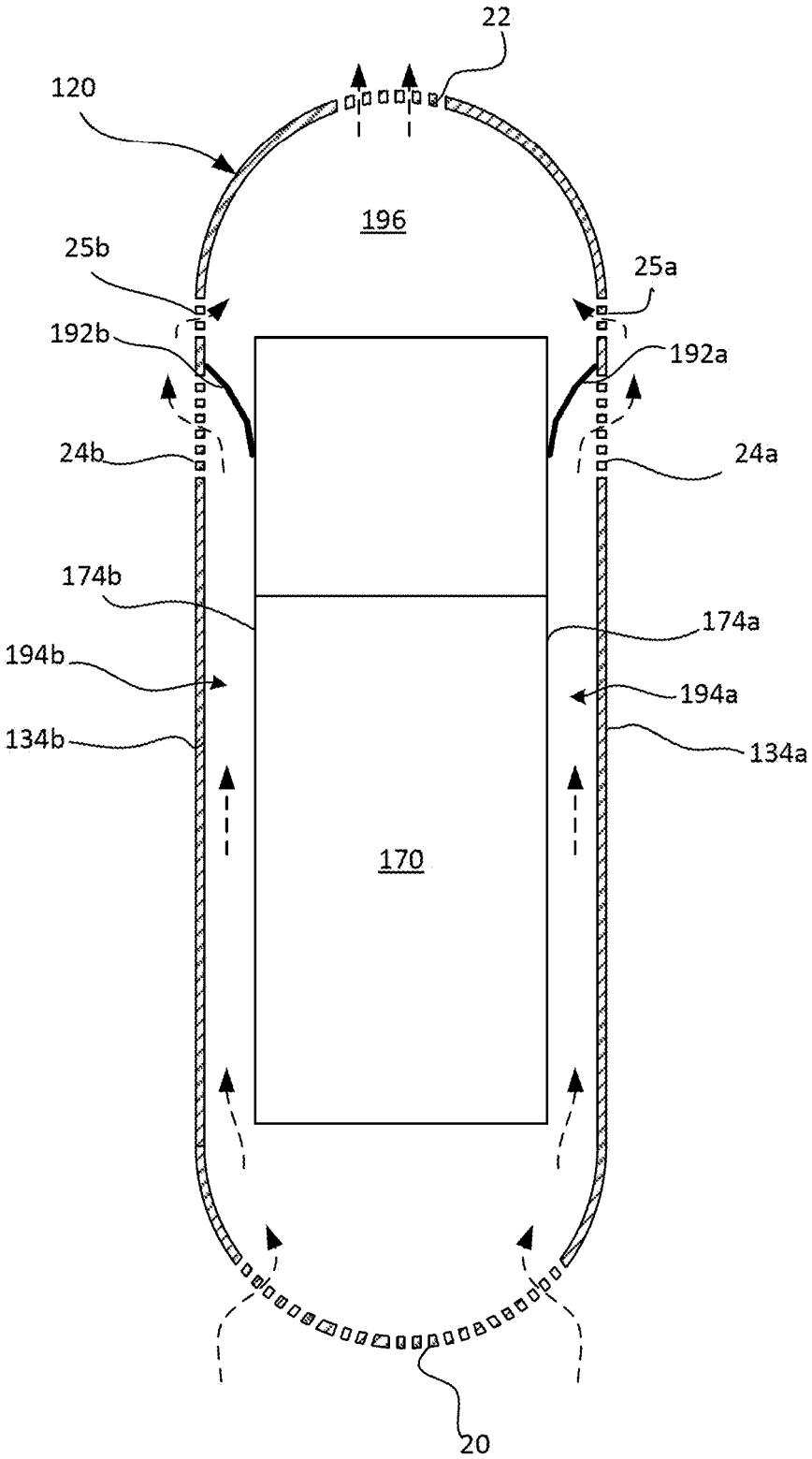
FIG. 4 illustrates a partial front cross-sectional view of a modular antenna unit showing separate flow paths through the unit.

As noted above, the housing is sized such that a space exists between the sidewalls 174 of the antenna unit 170 and the sidewalls 134 of the housing. These spaces each define a separate flow path through the interior of the housing for use in cooling the housing. Further, these separate flow paths are particularly suited for dissipating heat resulting from solar radiation impinging on the outside surfaces of the housing 120. This is best shown by the partial cross-sectional view of FIG. 4, wherein the front surface of the housing is removed for illustration purposes. As illustrated, a first flow path 194*a* is disposed between the first sidewall 174*a* of the antenna unit 170 and the first sidewall 134*a* of the antenna housing 120. Likewise, a second flow path 194*b* is disposed between the second sidewall 174*b* of the antenna unit 170 and the second sidewall 134*b* of the antenna housing 120*a*. In such an arrangement, air entering into a lower portion of the housing 120, for example through the lower vent 20, may pass upward between the antenna unit 170 and the upper vent 24*a* through the first flow path 194*a*. Additionally, air may pass upward between the antenna unit 170 and the upper vent 24*b* through the second flow path 194*b*. The positioning of the air flow paths 194*a*, 194*b* (e.g., ducts and on each side of the antenna unit permits dissipating heat (e.g., via natural convention) resulting from solar irradiation on the housing and/or from heat generated by the antenna unit. In either side flow path/duct 194*a* or 194*b*, heated air rises through the flow path until it reaches the vent 24*a* or 24*b*, respectively. To force the air to exit the housing 120, deflector plates 192*a* and 192*b* are positioned at the upper end of the flow paths 194*a*, 194*b*, respectively. More specifically, the deflector plates 192*a*, 192*b* are disposed at an angle between the sidewalls 174 and 134 to direct air out of the housing. In addition, the deflector plates at least partially isolate the side ducts 194*a*, 194*b* from an upper space/flow path 196 in the upper portion of the housing. This flow path 196 allows for air to enter secondary vents 25*a*, 25*b* in the sidewall 134*a*, 134*b* and exit through the upper housing vent 22. As noted, the various ducts 194*a*, 194*b* and 196 are at least partially isolated to provide separate air flow pathways through the housing. In this regard, the back plate assembly 190, the deflector plates 192*a*, 192 be and the ducts 40, 42 connected to the antenna unit 170 (see e.g., FIGS. 2*b* and 2*c*) partially isolate these ducts. While being partially isolated, it will be appreciated that the separate flow paths are not hermetically isolated. For instance, the sidewall ducts/airpaths 194*a*, 194*b* may share a common inlet. Nonetheless, the partially isolation permits air to flow separately through these ducts under the influence of thermal convection and/or heat from the antenna unit. As a result, the separate ducts well suited for removing heat caused by solar irritation impinging on the surfaces of the housing.

Figure 5:
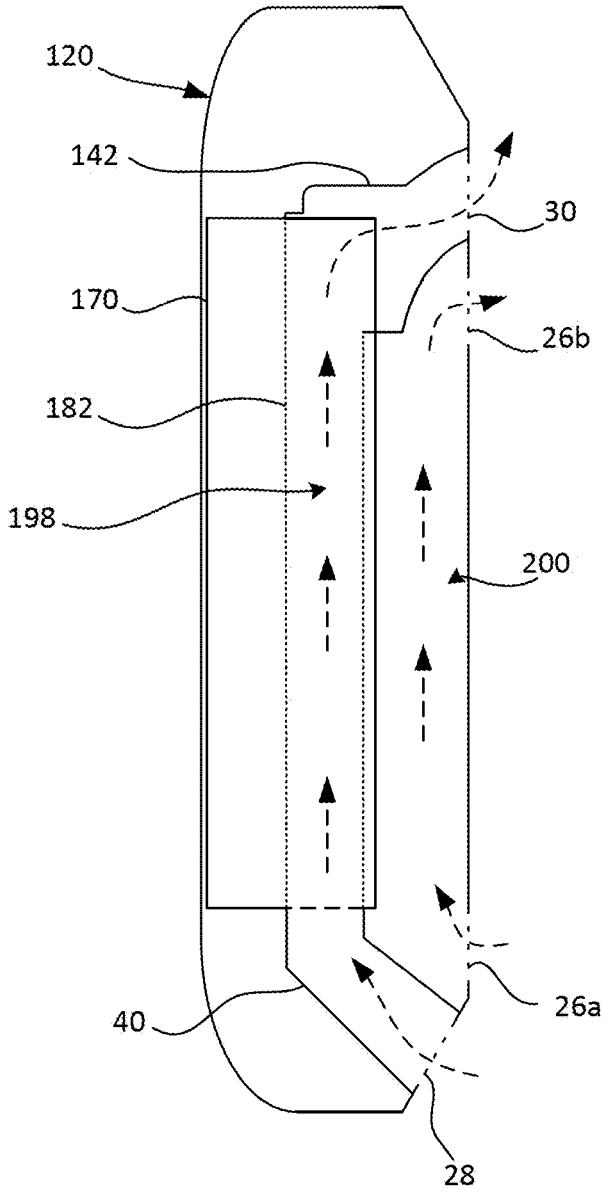
FIG. 5 illustrates a partial side cross-sectional view of a modular antenna unit showing separate flow paths through the unit.

FIG. 5 illustrates a partial side cross-sectional view to illustrate flow through additional flow paths of the housing. As noted above, the inlet and outlet ducts 40, 42 attach to the antenna unit and are positioned against the lower air intake vent 28 and the In this regard, air may be drawn (e.g., actively via a fan in the antenna unit—not shown) through an air path or duct 198 collectively defined by the air inlet vent 28, the intake duct 40, the internal duct 182 of the antenna unit, the outlet duct 42 and out the outlet vent 30. When utilizing a fan (e.g., disposed within the antenna unit; not shown) to draw air through this duct 98, such a duct or air path may be considered and active duct as opposed to a passive duct where convective forces provide circulation. Finally, the housing 120 may include an air path or duct 200 positioned behind the antenna unit 170 and in front of the rear wall of the housing 120. That is, air may pass between the lower vent 26*a* and the upper vent 26*b*. This air path is likewise substantially isolated from the other air path 194*a*, 194*b* and 196 by the backplate 190 and the air ducts 40, 42 attached to the antenna unit 170.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. An antenna assembly, comprising:

an elongated housing having an upper end, a lower end and a sidewall surface extending between the upper end the lower end, wherein the upper end, the lower end and the sidewall define an interior area of the housing;

an antenna unit disposed within the interior area, the antenna unit including:

an internal cooling duct; and an emitting surface of the antenna unit is directed outward from the interior area of the enclosure;

a first duct having a hollow interior extending between a first inlet end and a first outlet end, wherein the first inlet end engages an inlet vent extending through a surface of enclosure and the first outlet end engages an inlet of the internal cooling duct of the antenna unit;

a second duct having a hollow interior extending between a second inlet end and a second outlet end, wherein the second inlet end engages an outlet of the internal cooling duct of the antenna unit and the second outlet end engages an outlet vent extending through a surface of the enclosure, wherein the first duct, the second duct and the internal cooling duct of the antenna unit define a first airflow path through the housing.

2. The antenna assembly of claim 1, wherein the elongated housing comprises a front sidewall, first and second elongated sidewalls, an upper end wall, a lower end wall and a rear sidewall.

3. The antenna assembly of claim 2, wherein the antenna unit comprises a front surface, first and second elongated side surfaces, an upper surface, a lower surface and a rear surface.

4. The antenna assembly of claim 3, wherein the internal cooling duct extends through the antenna unit between the upper surface and the lower surface.

5. The antenna assembly of claim 3, wherein the first elongated sidewall of the housing is spaced from the first elongated side surface of the antenna unit and the second elongated sidewall of the housing is spaced from the second elongated side surface of the antenna unit.

6. The antenna assembly of claim 5, further comprising:

a first sidewall vent extending through the first elongated sidewall proximate to the upper end wall of the housing; and a lower vent extending though the housing proximate to the lower end wall of the housing, wherein a first space between the first elongated sidewall of the housing and the first elongated side surface of the antenna unit defines a second airflow path through the housing between the lower vent and the first sidewall vent.

7. The antenna assembly of claim 6, further comprising:

a second sidewall vent extending through the second elongated sidewall proximate to the upper end wall of the housing, wherein a second space between the second elongated sidewall of the housing and the second elongated side surface of the antenna unit defines a third airflow path through the housing between the lower vent and the second sidewall vent.

8. The antenna assembly of claim 6, further comprising:

a deflector extending between the first elongated side surface of the antenna unit and the first elongated sidewall of the housing to deflect air in the second airflow path through the first sidewall vent.

9. The antenna assembly of claim 8, wherein the deflector is disposed at an angle relative to the first elongated side surface of the antenna unit.

10. The antenna assembly of claim 3, wherein the rear surface of the antenna unit is spaced from the rear sidewall of the antenna housing.

11. The antenna assembly of claim 10, further comprising:

a first rear sidewall vent extending through the rear sidewall proximate to the upper end wall of the housing; and a lower vent extending though the housing proximate to the lower end wall of the housing, wherein a rear space between the rear sidewall of the housing and the rear surface of the antenna unit defines a rear airflow path through the housing between the lower vent and the first rear sidewall vent.

12. The antenna assembly of claim 3, wherein the front surface of the antenna unit is juxtaposed against the front sidewall of the housing.

13. The antenna assembly of claim 12, wherein the emitting surface of the antenna unit is exposed through an antenna aperture through the front sidewall of the housing.

14. The antenna assembly of claim 1, wherein the housing comprises:

a front shroud; and a rear shroud, wherein the front shroud and rear shroud are configured to engage to define the interior area of the housing.

* * * * *